US007758335B2

(12) United States Patent
Marty et al.

(10) Patent No.: US 7,758,335 B2
(45) Date of Patent: Jul. 20, 2010

(54) METHOD FOR UTILIZING PRODUCT LEAKS IN COMPRESSOR SEAL SYSTEMS FOR RECOVERY AND RECYCLING AS FUEL

(75) Inventors: Pascal Marty, Paris (FR); Marie-Pascal Victor, Paris (FR)

(73) Assignee: L'Air Liquide, Societe Anonyme a Directoire et Conseil de Surveillance pour l'Etude et l'Exploitation des Procedes Georges Claude, Paris (FR)

( * ) Notice: Subject to any disclaimer, the term of this patent is extended or adjusted under 35 U.S.C. 154(b) by 1105 days.

(21) Appl. No.: 11/432,711

(22) Filed: May 11, 2006

(65) Prior Publication Data

US 2006/0275716 A1 Dec. 7, 2006

(30) Foreign Application Priority Data

May 17, 2005 (FR) ..... 05 51268

(51) Int. Cl.
*F23G 7/08* (2006.01)

(52) U.S. Cl. ..... 431/5; 431/12; 431/89; 431/90

(58) Field of Classification Search ..... 431/5, 431/12, 89, 90, 61; 137/119.09, 119.1
See application file for complete search history.

(56) References Cited

U.S. PATENT DOCUMENTS

| | | | |
|---|---|---|---|
| 4,095,934 | A | 6/1978 | Jensen et al. |
| 4,468,193 | A | 8/1984 | Lawrence et al. |
| 4,983,364 | A | 1/1991 | Buck et al. |
| 5,344,313 | A | 9/1994 | Johnsen, Jr. |

*Primary Examiner*—Alfred Basichas
(74) *Attorney, Agent, or Firm*—Elwood L. Haynes

(57) ABSTRACT

A method for utilizing a combustible gas product collected in the seal device of a compressor of the combustible gas produce, in particular a method in which combustible gases, or gas mixtures containing combustible gases, are compressed, is provided. The method is particularly advantageous in applications in the field of the production and/or processing of synthesis gas, for producing and/or processing combustible gases or gas mixtures containing combustible gases including in particular $H_2$, CO, $CH_4$, natural gas and $CO_2$.

6 Claims, 1 Drawing Sheet

Figure 1:
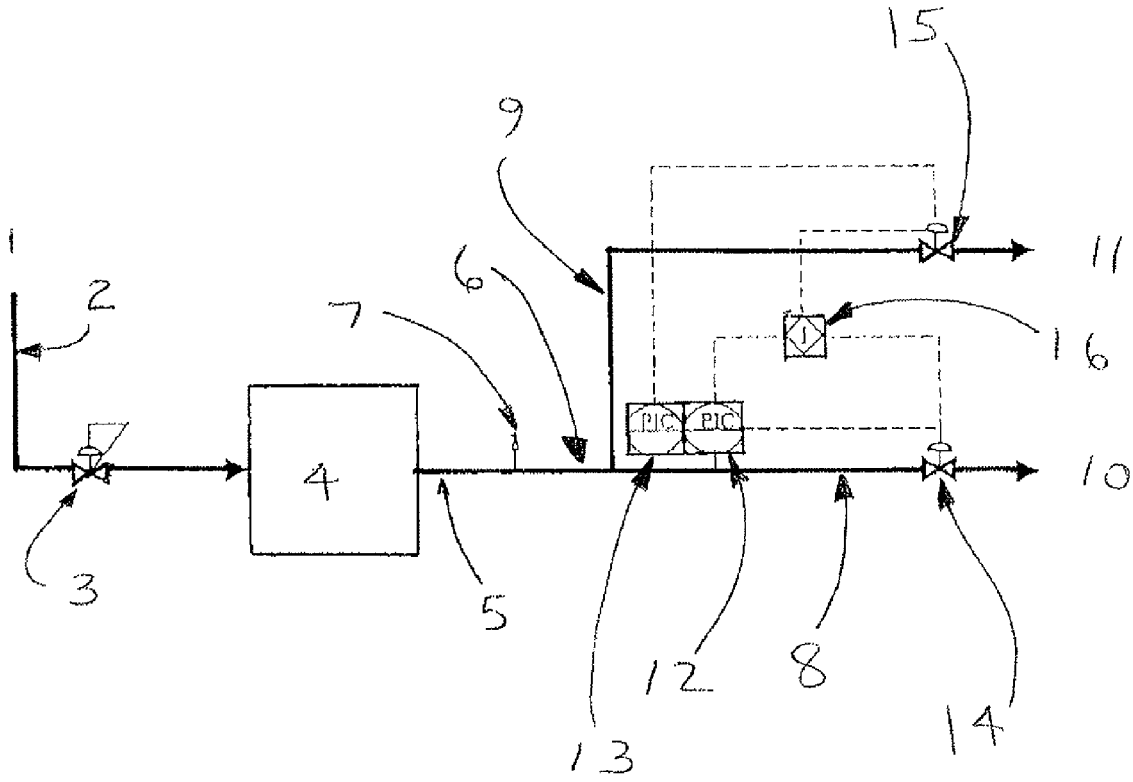

METHOD FOR UTILIZING PRODUCT LEAKS IN COMPRESSOR SEAL SYSTEMS FOR RECOVERY AND RECYCLING AS FUEL

This application claims the benefit of priority under 35 U.S.C. §119 (a) and (b) to French Application No. 0551268, filed May 17, 2005, the entire contents of which are incorporated herein by reference.

BACKGROUND

The present invention relates to a method for utilizing a combustible gas product collected in the seal device of a compressor of the said combustible gas product.

The invention applies to methods in which combustible gases, or gas mixtures containing combustible gases, are compressed. It finds a particularly advantageous application in the field of the production and/or processing of synthesis gas (HYCO process), for producing and/or processing combustible gases or gas mixtures containing combustible gases including in particular $H_2$, CO, $CH_4$, natural gas and $CO_2$.

In processes handling this type of product, it is in fact frequently necessary, during the process, to compress at least one of the gas products used on the installation. Examples include:

hydrogen produced, compressed for client needs, synthesis gas compressed for the needs of its purification, carbon monoxide compressed for cooling needs and/or client needs.

Gas compressors are well known of the reciprocating or centrifugal type, with labyrinth or dry face seal systems.

Despite the seal devices mounted on the compressors, leaks of compressed gas product are inevitable in each compression cylinder, between the piston rod and the cylinder. In fact, the clearance between the mobile piston rod and the seals generates a residual leakage rate which, although low, must be controlled. Moreover, these product losses, due to inefficient sealing, progressively increase seal wear. In consequence, the leakage gas rate is never zero, and gradually increases with seal wear.

These products, whether hydrogen, carbon oxides, methane or other, must for various reasons, and particularly for safety and environmental reasons, due to their hazardous (toxic and/or explosive) nature, be burned before discharge to the atmosphere.

To solve this problem, plants conventionally recover these combustible products originating in leaks in the compressors and send them to a flare where they burn in the presence of air, releasing carbon dioxide and steam.

However, products sent to the flare are not at all utilized. On the contrary, they exacerbate pollution and contribute to the greenhouse effect. As the compressor ages, the quantity of leakage gas increases and a growing quantity of product is removed without any utilization.

For various reasons, particularly price and cost of the gas concerned, it is essential to limit the quantity of gas sent to the flare.

At the same time, the method employed in the installation generally comprises one or more endothermic steps which require a heat input. In certain cases, this heat input at least partly originates from heat exchange between fluids. Steam in particular provides at least part of the needs, but in the case of high heat requirements, in the context, for example, of steam reforming to produce hydrogen and/or carbon monoxide, alone or in mixtures, heat is needed, supplied by a combustion reaction. In this case, the fuel used at least partly contains combustible products recycled from various steps of the process (for example, PSA waste gases, cold box waste gases such as methane waste, flash gas) and partly imported fuel, often a fraction of the feed supplying the process (or primary gas), generally natural gas. The waste gases and the primary gas fraction are mixed and sent via a fuel header to the burners required for the combustion reaction.

Thus, the leakage gas products issuing from the seal devices of compressors for compressing the products represent an upgrading opportunity; these product losses due to inefficient compressor sealing, can, for example, reach up to 5% of $H_2$ output in the case of hydrogen production. Simultaneously, the process generally requires heat inputs, often entailing reliance on combustion reactions supplied with gaseous fuels.

It is the object of the present invention to provide a solution to the problem of the loss of the upgradeable products via leaks in the compression steps of the process.

A further object of the invention is to limit the consumption of fuel originating from an external source to the process.

In the context of hydrogen production, one object of the invention is thus to utilize—at its value as fuel—the hydrogen produced corresponding to a fraction of up to 5% of production.

For this purpose, a subject of the invention is a method for utilizing a combustible gas product collected in the seal device of a compressor of the said combustible gas product, comprising the steps of:

a) feeding the seal device of the said compressor with an inert gas flow, b) recovery at the outlet of the said seal device of a gas flow containing all or part of the inert gas flow of step a) and all or part of the gas flow of combustible product collected in the said compressor seal device, to supply a line connected to the outlet of the seal device, c) separation of the said gas flow (mixture of inert gas and the gas flow of combustible product) at the outlet of the said line into two gas flows, the first to be sent to a fuel header connected to burners, and the second being sent to a flare to be burned (the lines conveying the gas flows of steps b) and c) constituting the leak circuit). The pressure in the seal device is maintained at a pressure above the gas pressure in the fuel header.

Advantageously, the inert gas used is nitrogen, due to its availability on site.

Preferably, the pressure in the leak circuit is controlled by means of two pressure controllers (PIC), the first actuating a valve mounted on the feed line to the fuel header, while the other, set at a higher pressure, actuates a valve mounted on the line supplying the flare. This arrangement is justified by the fact that if, for any reason whatsoever (particularly in the case of excessive pressure in the fuel header) the first PIC and the associated valve cannot remove the entire gas flow, the pressure will continue to rise in the leak circuit. The second PIC then becomes active and opens the valve to the flare, removing the surplus gas that cannot be recycled to the burners. Typically, the second PIC has a set point of about 200 mbar above the set point of the first PIC.

Advantageously, the leak circuit is also equipped with a synchronization device which closes the valve mounted on the feed line of the fuel header, while it forces open the valve mounted on the line supplying the flare in one or the other of the following two cases:

if the pressure in the leak circuit is very high, to avoid actuating the valve located on the line connected to the outlet of the seal device (and hence the venting of the gas products flowing in the line). For this purpose, the pressure set point of this valve is slightly higher than the pressure controlling the opening of the valve mounted on the feed line to the flare;

if the pressure in the fuel header is higher than the pressure in the leak circuit, there is a possibility of the passage of fuels into the seal system.

The method of the invention is particularly advantageous in the case in which the combustible gas product is hydrogen. In fact, in the case of hydrogen production, the losses observed in the hydrogen compressor seal systems may be up to 5% of production.

The method of the invention serves to utilize them as fuel instead of losing them completely.

The method is advantageously applied to the recovery of combustible products used during the production and/or processing of synthesis gas.

The invention will now be described with reference to the single FIGURE appended hereto; other features and advantages of the invention will appear.

It should be understood that this represents a particular embodiment of the invention, provided as a non-limiting example and that the invention is not limited to this embodiment.

The FIGURE shows a flowchart showing a preferred embodiment of the invention for the utilization of leaks of products recovered in the seal devices of product compressors corresponding to an example of the recovery of leaks originating from a hydrogen compressor in an application of the invention.

Nitrogen 1, conveyed via the line 2 and the valve 3, is injected into the seal system 4 of the hydrogen compressor.

The gas mixture 5 containing the injected nitrogen and the hydrogen issuing from the compressor leaks is recovered in the seal system 4 and sent to the line 6, which is equipped with a valve 7 designed to prevent overpressure.

The line 6 is a common section to the two lines 8 and 9, the line 8 supplying the fuel header 10, while the line 9 is connected to the flare 11.

The pressure in the leak circuit (the lines 6, 8, 9) is controlled by two PIC-type pressure controllers 12 and 13.

The pressure controller 12, called the main controller, actuates the valve 14 controlling the sending of the leakage gas to the header of the "fuel header" pressure circuit, while the secondary PIC 13, set at a higher pressure than that of the controller 12, of 200 mbar for example, actuates the valve 15 controlling the sending of gas to the flare 11.

The pressure in the fuel header is usually between 1 and 2 bar absolute, preferably about 1.3 bar absolute.

However, it should be noted that the fuel header is, by construction, mechanically able to withstand a pressure of up to 7 bar absolute, and in case of excessive pressure on the fuel header side, gas reflux could occur towards the lines 8, then 6, increasing the gas pressure in these lines, which may cause damage to the compressor seal system (it should in fact be observed that a pressure increase will tend to completely open a pressure controlled valve—hence the valves actuated by the PIC).

In order to protect the compressor seal system, the line 6, as described above, is provided with the valve 7.

Furthermore, a logic safety device 16 has also been installed, operating as follows:

in case of very high pressure in the leak circuit, the valve 14 to the fuel header is closed, and the valve 15 to the flare is forced open completely (operation in full manual mode).

Similarly, if the fuel header is shut off or if the pressure therein is higher than that of the gas in the leak circuit, action is similarly taken by closing the valve 14 and by forcing open the valve 15 to the flare 11.

It will be understood that many additional changes in the details, materials, steps and arrangement of parts, which have been herein described in order to explain the nature of the invention, may be made by those skilled in the art within the principle and scope of the invention as expressed in the appended claims. Thus, the present invention is not intended to be limited to the specific embodiments in the examples given above.

What is claimed is:

1. Method for utilizing a combustible gas product collected in a compressor of the said combustible gas product, the compressor having a seal device, the method comprising the steps of:

a) feeding the seal device of the compressor with an inert gas flow, wherein the compressor increases the pressure of a combustible product, wherein at least a portion of the gas flow of the combustible product collects in the seal device, and wherein the seal device comprises an outlet, b) recovery at the outlet of the seal device of a composite gas flow containing all or part of the inert gas flow of step a) and all or part of the gas flow of combustible product collected in the compressor seal device, to supply a line connected to the outlet of the seal device, c) separation of the composite gas flow at the outlet of the line into two gas flows, the first being intended to feed a fuel header connected to burners, and the second being sent to a flare to be burned, the lines conveying the gas flows of steps b) and c) comprising a leak circuit, wherein the pressure in the seal device is maintained at a pressure above the gas pressure in the fuel header.

2. Method according to claim 1, wherein the inert gas fed to the seal device is nitrogen.

3. Method according to claim 1, wherein the leak circuit comprises a first pressure controller and a first valve mounted on the supply line of the fuel header and a second pressure controller and a second valve mounted on the line supplying the flare, wherein the pressure in the leak circuit is controlled by means of the first and second pressure controllers, wherein the first pressure controller actuates the first valve and the second pressure controller, which is set at a higher pressure, actuates the second valve.

4. Method according to claim 3, wherein the leak circuit further comprises a synchronization device which closes the first valve, while said synchronization device forces open the second valve in one or the other of the following two cases:

the pressure in the leak circuit is very high, the pressure in the fuel header is higher than the pressure in the leak circuit.

5. Method according to claim 1, in which the combustible gas product is hydrogen.

6. Application of the method according claim 1 to the recovery of combustible products used during the production and/or processing of synthesis gas.

* * * * *